US011930909B2

(12) United States Patent
Lee

(10) Patent No.: US 11,930,909 B2
(45) Date of Patent: Mar. 19, 2024

(54) STICK CONTAINER HAVING SEALING STRUCTURE FOR PREVENTING RESIDUE

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 17/950,029

(22) Filed: Sep. 21, 2022

(65) Prior Publication Data

US 2023/0107286 A1 Apr. 6, 2023

(30) Foreign Application Priority Data

Oct. 1, 2021 (KR) ..... 10-2021-0130637

(51) Int. Cl.
*A45D 40/06* (2006.01)

(52) U.S. Cl.
CPC ..... *A45D 40/06* (2013.01); *A45D 2200/051* (2013.01)

(58) Field of Classification Search
CPC ..... A45D 40/04; A45D 40/06; A45D 40/14; A45D 2200/051
USPC ..... 401/76
See application file for complete search history.

(56) References Cited

U.S. PATENT DOCUMENTS

| | | | | |
|---|---|---|---|---|
| 6,340,258 | B2 * | 1/2002 | Gueret | A45D 40/04 401/98 |
| 6,343,886 | B2 * | 2/2002 | Shochat | A45D 40/06 401/87 |
| 6,629,797 | B1 * | 10/2003 | Lee | A45D 40/04 401/78 |
| 7,553,101 | B2 * | 6/2009 | Harano | A45D 40/12 401/98 |
| 11,076,679 | B1 * | 8/2021 | Chung | A45D 40/04 |
| 11,622,613 | B1 * | 4/2023 | Chung | A45D 40/06 401/75 |
| 2021/0007463 | A1 * | 1/2021 | Lee | A45D 40/06 |

FOREIGN PATENT DOCUMENTS

| | | |
|---|---|---|
| KR | 10-2017-0049149 A | 5/2017 |
| KR | 10-2021-0097018 A | 8/2021 |

* cited by examiner

*Primary Examiner* — David P Angwin
*Assistant Examiner* — Bradley S Oliver
(74) *Attorney, Agent, or Firm* — Heedong Chae; Lucem, PC

(57) ABSTRACT disclosed is a stick container having a sealing structure for preventing a residue, which includes: a main body formed thereon with an elevation protrusion; a sealing tube coupled into the main body and formed with first and second sealing parts; a guide tube rotatably coupled into the main body and formed with an inlet part; a first holder coupled into the guide tube; a second holder coupled into the first holder and formed with an elevation thread; and a main body cover opening and closing the guide tube and formed with a sealing cap, wherein the first sealing part comes into close contact with the main body to seal a space between the main body and the sealing tube, and the second sealing part simultaneously comes into close contact with the guide tube to seal a space between the sealing tube and the guide tube.

11 Claims, 9 Drawing Sheets

STICK CONTAINER HAVING SEALING STRUCTURE FOR PREVENTING RESIDUE

CROSS REFERENCE TO RELATED APPLICATION

The present application claims priority to Korean Patent Application No. 10-2021-0130637, filed on Oct. 1, 2021, the entire contents of which is incorporated herein for all purposes by this reference.

BACKGROUND OF THE INVENTION

1. Field of the Invention

The present invention relates to a residual quantity prevention stick container having a sealed structure, and more particularly, to a residual quantity prevention stick container having a sealed structure to prevent contamination and deterioration of a stick cosmetic accommodated therein through a systematic coupling relationship and a stable sealing structure between adjacent components.

2. Description of the Related Art

In today's modern society, both men and women of all ages use cosmetics upon needs in accordance with the rapid diversification trend of the times. In particular, women use cosmetic products and cosmetic tools with various types and various colors, and various high-quality cosmetic products and tools are being released into the market everyday through the research and development of cosmetics-related companies.

According to the purpose of use, the cosmetics are classified into, for example, facial cleansing cosmetics used for removing sebum, wastes and contaminants on a surface of a skin, base cosmetics used for properly supplying moisture and oil to the skin, color cosmetics used for expressing beautiful colors, hair cosmetics used for protecting hairs and supplying nutrition as well as removing foreign substances from hairs or scalp, and perfumes obtained by dissolving fragrant materials in alcohol or the like and used for giving a fragrance to others.

The color cosmetics are divided into a base makeup used for uniformizing the skin color and cover the defects, and a point makeup for partially enhancing the three-dimensional feeling such as lips, eyes, nails. The base makeup includes a makeup base, a foundation, a powder, and so on, and the point makeup includes a lipstick, an eye liner, and a mascara.

In addition, the foundation refers to cosmetics used to naturally hide blemishes or melasma on the skin, such as the face, exposed to the outside, or express the clean and bright skin or clear and soft skin. When used for makeup, the foundation is spread evenly on the skin without clumping by using a cosmetic puff.

The foundation is usually stored in a wide and flat compact container, and the puff is accommodated inside the compact container together.

However, in order to use the foundation accommodated in the compact container, a user is required to open a lid of the container, hold the puff accommodated on an upper lid of an inner container, open the lid of the inner container, and then apply the foundation cosmetics to the skin by using the puff. Thus, it is inconvenient to use, and a hand of the user gets dirty because the foundation cosmetics remaining on the puff are put thereon in the above process.

Accordingly, for the convenience in use and the convenience in portable storage, a stick-type cosmetic container has been developed in which a stick-type cosmetic is mounted on one side of a container, and the stick-type cosmetic mounted inside the container is used by raising and lowering the stick-type cosmetic according to rotation of the container.

For the conventional stick-type cosmetic container having the above structure, Korean Unexamined Patent No. 10-2017-0049149 (hereinafter referred to as 'related art') discloses a lipstick container in which a lipstick is drawn out or drawn in by screw rotation, and the related art will be described as follows.

the above related art includes: a lipstick case; a guide tube coupled to an upper inner side of the lipstick case and formed with a guide protrusion on an inner circumference; a rotating body coupled to a lower inner side of the lipstick case and the guide tube, and formed with a rotating body thread on an upper inner circumference; a lipstick plate coupled to an upper inner side of the guide tube, formed on a lower outer circumference thereof with a plate thread screwed with the rotating body thread, and formed on one side of the plate thread with a vertical guide groove into which the guide protrusion is inserted; a lipstick mounted on the lipstick plate; and a lipstick cover detachably coupled to the upper part of the lipstick case.

However, the conventional lipstick container wastes resources since all of the lipstick cosmetics remaining in the lipstick plate cannot be used. In addition, it is inconvenient to use a separate tool to constrainedly dig and use the stick-type cosmetics remaining in the lipstick plate.

In order to solve the above-described problems, Korean Unexamined Patent No. 10-2021-0097018 (hereinafter referred to as 'related art') discloses a stick-type cosmetic container. The above related art includes: a body; a rotating body rotatably coupled to a main body and having a rotating thread; an elevating member coupled to an inside of the main body to elevate, provided with a stick cosmetic, and formed thereon with an elevating thread; a residue withdrawal member coupled to the elevating member to push out the stick cosmetic and formed thereon with a screw protrusion; an elastic member formed between the elevating member and the residue withdrawal member; and a cover detachably coupled to the rotating body. Accordingly, when the stick-type cosmetic container is used, the stick-type cosmetics accommodated therein are entirely used without any residue.

However, since the above related art has no airtight structure between the main body and the rotating body rotated with respect to the main body and at an inlet of the main body, external air is introduced through gaps. Accordingly, when carried or stored, the stick cosmetics stored in the rotating body are hardened or contaminated and deteriorated. In addition, according to the above related art, since the elevating member to which the stick cosmetic is attached and the residue withdrawal member for pushing the stick cosmetics remaining in the elevating member to the outside are separately screwed with the main body and operated, the productivity may be decreased due to the complicated assembling, and the smooth withdrawal operation of the stick cosmetic may be hindered.

(Patent Document 1) Korean Patent Publication No. 10-2017-0049149 (Published on May 10, 2017)

(Patent Document 2) Korean Patent Publication No. 10-2021-0097018 (Published on Aug. 6, 2021)

SUMMARY OF THE INVENTION

In order to solve the above problems, the present invention provides a stick container having a sealing structure for preventing a residue in which a sealing tube is formed between a main body and a guide tube to simultaneously seal spaces between the main body and the sealing tube and between the sealing tube and the guide tube, and a sealing cap is formed on an inside of a main body cover to seal an inlet of the guide tube, so that the stick cosmetic accommodated in the guide tube may be prevented from being contaminated and deteriorated when being carried or stored.

In order to achieve the above-mentioned object, The present invention provides a stick container having a sealing structure for preventing a residue, which includes: a main body formed thereon with an elevation protrusion; a sealing tube coupled to an inside of the main body, and formed therein with a first sealing part and a second sealing part; a guide tube rotatably coupled to the inside of the body, and formed on one side thereof with an inlet part; a first holder coupled to an inside of the guide tube so as to be movable in a straight line, in which a stick cosmetic is attached to the first holder; a second holder coupled to an inside of the first holder, and formed thereon with an elevation thread; and a main body cover opening and closing at least a portion of the guide tube, and formed therein with a sealing cap, wherein the first sealing part comes into close contact with an inner circumference of the main body to seal a space between the main body and the sealing tube, and the second sealing part simultaneously comes into close contact with an outer circumference of the guide tube to seal a space between the sealing tube and the guide tube, and the sealing cap covers and comes into close contact with the inlet part of the guide tube, thereby sealing an inside of the guide tube.

In addition, the main body may be formed on one side thereof with a filling hole through which the stick cosmetic is filled, and a lower cap may be coupled to the filling hole.

In addition, the lower cap may be formed thereon with an inner extension protrusion wheel and an outer extension protrusion wheel outwardly spaced apart from the inner extension protrusion wheel at a predetermined interval, in which the inner extension protrusion wheel and the outer extension protrusion wheel are formed thereon with an inner sealing protrusion and an outer sealing protrusion, respectively, thereby dually sealing the inside of the main body while coming into close contact with an inner wall of the main body.

In addition, a seating protrusion wheel seated on an upper end of the main body may protrude on an outer circumference of the sealing tube, in which the seating protrusion wheel is formed at one side thereof with a sealing part inserted into the main body to seal a space between the main body and the guide tube, and the seating protrusion wheel is formed at an opposite side thereof with a detachable part exposed to an outside of the main body and detachably coupled to the main body cover.

In addition, the first sealing part may be formed to be opened outward toward an end of the sealing part to come into close contact with the inner circumference of the main body.

In addition, the second sealing part may protrude along the inner circumference of the sealing part to come into close contact while surrounding the outer circumference of the guide tube.

In addition, a first locking protrusion may protrude from the inner circumference of the sealing tube, and a second locking protrusion may protrude from the outer circumference of the guide tube so as to be locked and coupled to each other.

In addition, the guide tube may be formed therein with a partition plate, in which the partition plate is formed therein with a first through-hole through which the first holder passes to guide a linear movement of the first holder, and a second-through hole, through which the second holder passes to guide a linear movement of the second holder, is formed at an inner side of the first through-hole.

In addition, the first holder may include an accommodation part for accommodating the cosmetic stick, and a lower extension part extending from the accommodation part to one side.

In addition, the second holder may include a holder plate disposed inside the first holder to push out the stick cosmetic accommodated in the first holder, and an elevation part extending from one side of the holder plate and lifted and lowered by rotating the main body.

In addition, the first holder and the second holder may be formed thereon with a first locking protrusion wheel and a second locking protrusion wheel, respectively, so as to be locked and coupled to each other so that the first holder and the second holder are lifted and lowered together in a predetermined section.

In addition, the sealing cap may be formed on an inner circumference thereof with an oblique surface to come into close contact with an upper edge of the guide tube, and the inner circumference of the sealing cap may simultaneously come into close contact with the upper outer circumference of the guide tube.

According to the embodiment of the present invention, a sealing tube is formed between a main body and a guide tube to simultaneously seal spaces between the body and the sealing tube and between the sealing tube and the guide tube, and a sealing cap is formed on an inside of a main body cover to seal an inlet of the guide tube, so that the stick cosmetic accommodated in the guide tube can be prevented from being contaminated and deteriorated when being carried or stored.

According to the embodiment of the present invention, the first holder and the second holder may be sequentially lifted and lowered by the rotation operation of the main body, to use all of the stick cosmetic attached to the first and second holders without waste, so that the waste of resources can be minimized, and the separate disposal after completion of use can be facilitated.

According to the embodiment of the present invention, the stick cosmetic can be taken out while stably maintaining the airtight inside the guide tube by the sealing tube between the main body and the guide tube, the operation can be smoothly performed through the above systematic coupling relationship between adjacent components, and the assembly process can be improved to increase productivity.

DETAILED DESCRIPTION OF THE INVENTION

Figure 1:
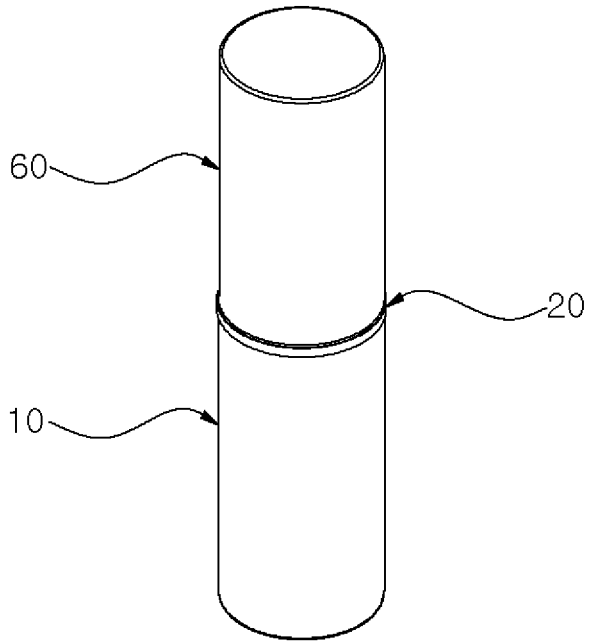
FIG. 1 is a perspective view showing a stick container according to the embodiment of the present invention.

Hereinafter, the detailed descriptions of the present invention are embodiments for carrying out the present invention, and the corresponding embodiment refers to the accompanying drawings as an example. The embodiments will be described in detail to enable those skilled in the art to carry out the present invention. It is apparent to be understood that the various embodiments of the present invention may be different from each other but do not need to be mutually exclusive. For example, the particular shape, structure, and feature described herein may be embodied in other embodiments without departing from the idea and scope of the present invention in connection with the embodiment. In addition, it will be understood that the location or arrangement of an individual element within each disclosed embodiment may be modified without departing from the idea and scope of the present invention.

Accordingly, the following detailed description is not intended to disclose a limited meaning, and the scope of the invention is limited only by the appended claims, along with the full scope of equivalents to which the claims are entitled, if properly explained. Similar reference numerals in the drawings refer to the same or similar function throughout several aspects.

General term which is widely used recently has been selected in the present invention in consideration of the function according to the present invention as possible, however, the term may vary depending on the intention of those skilled in the art, judicial cases, the advent of new technology, or the like. In addition, in certain cases, the term may be arbitrarily selected by the applicant, and in this case, the meaning thereof will be described in detail in the relevant description of the invention. Therefore, the term used in the present invention should be defined based on the meaning of the term and contents throughout the present invention, not simply on the name of the term.

When one part "includes" one element in the present invention, the above expression does not exclude other elements, but may further include the other elements, unless particularly stated otherwise.

Hereinafter, a stick container having a sealing structure for preventing a residue according to the embodiment of the present invention will be described in detail with reference to the accompanying drawings.

Figure 2:
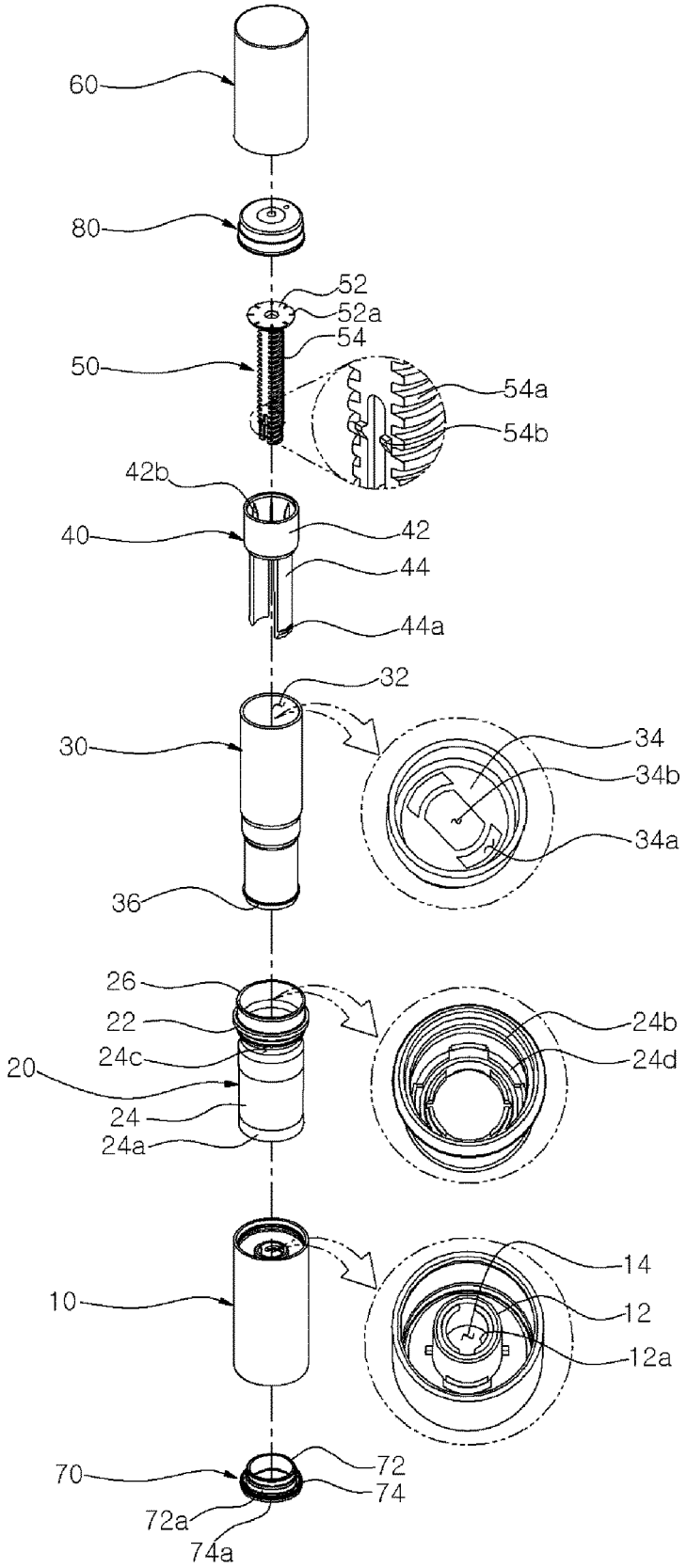
FIG. 2 is an exploded perspective view of the stick container according to the embodiment of the present invention.
Figure 3:
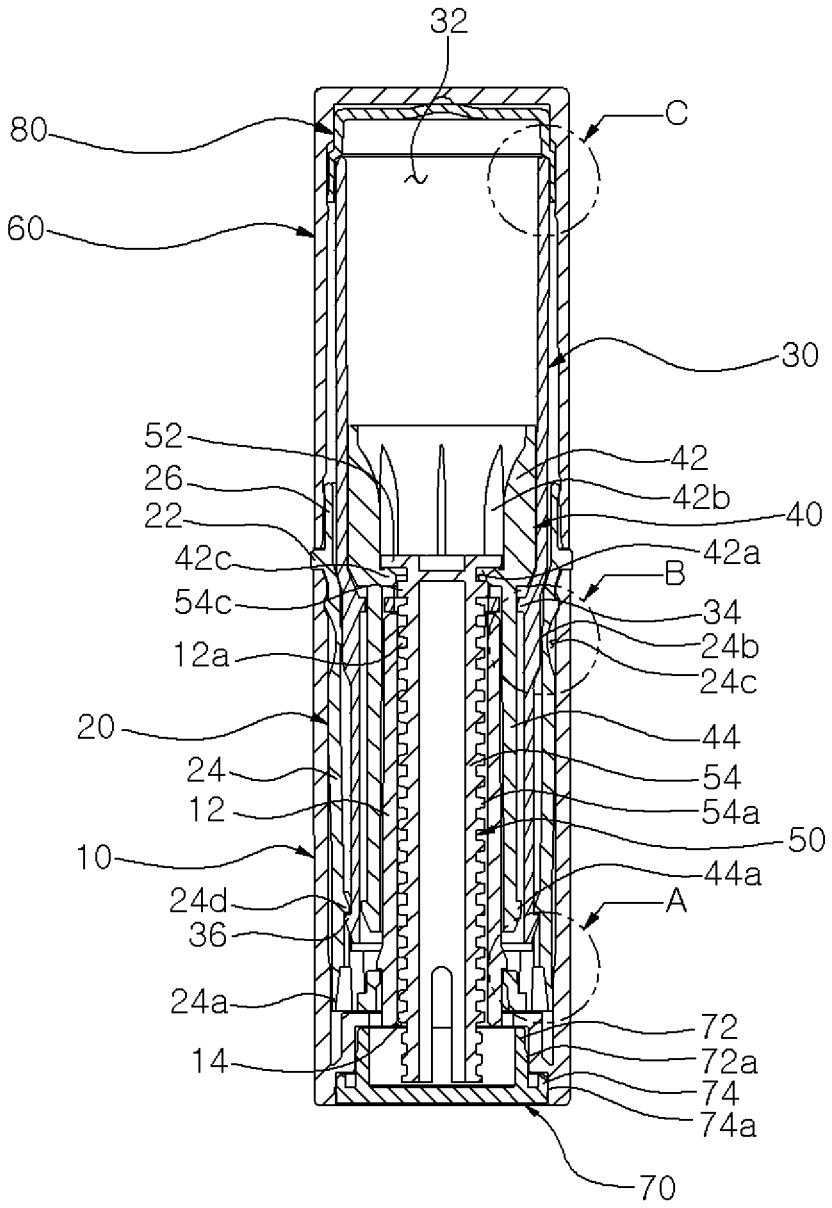
FIG. 3 is a sectional view showing the stick container according to the embodiment of the present invention.
Figure 4:
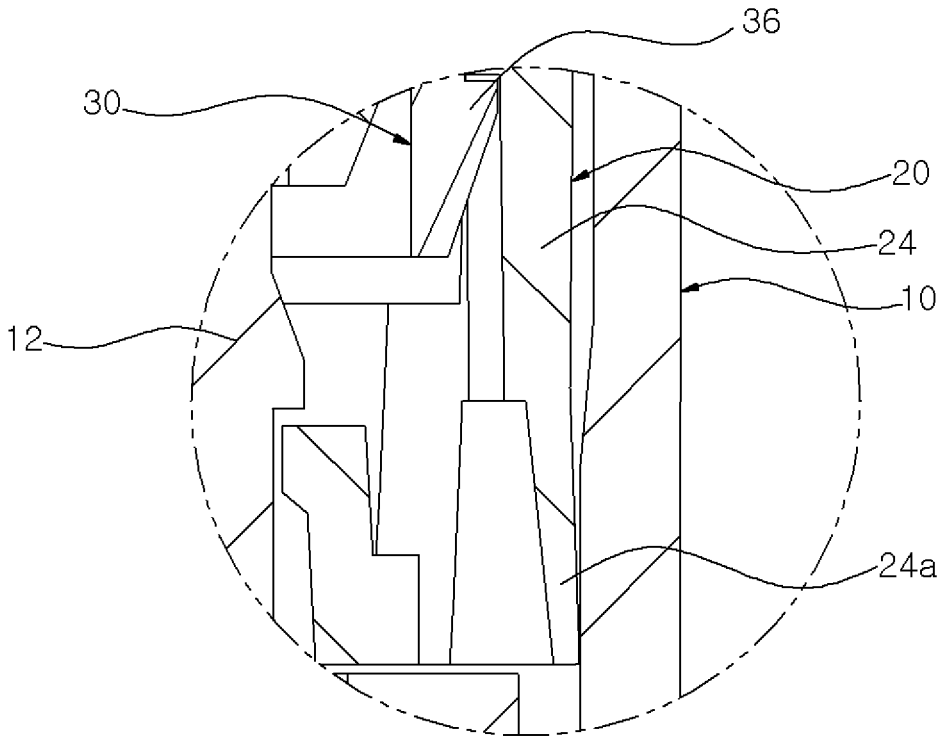
FIG. 4 is an enlarged view of portion A of FIG. 3.
Figure 5:
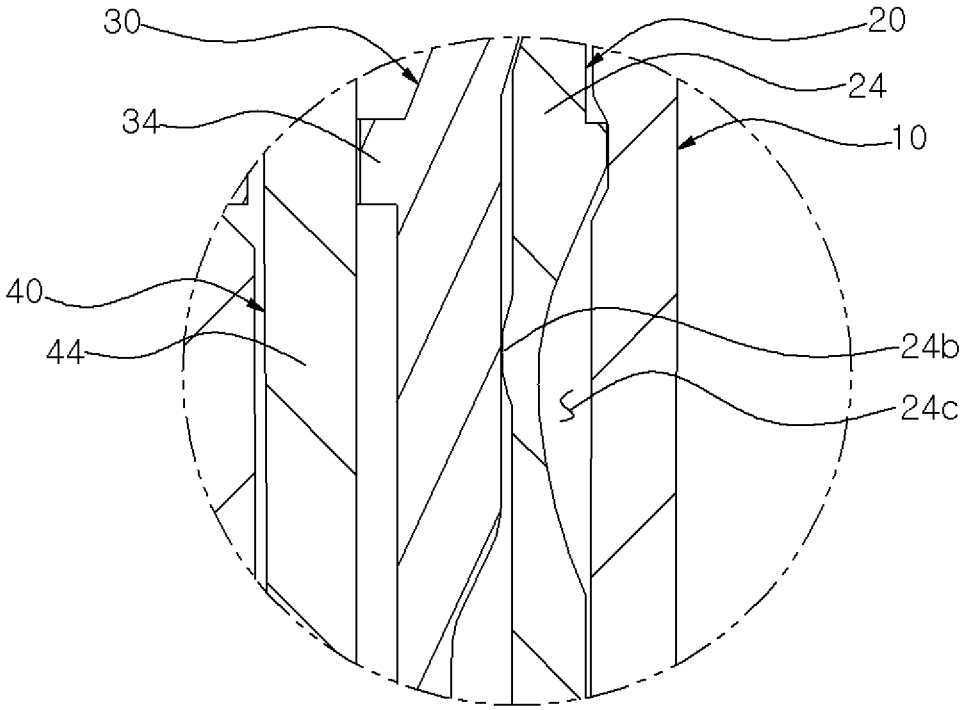
FIG. 5 is an enlarged view of portion B of FIG. 3.
Figure 6:
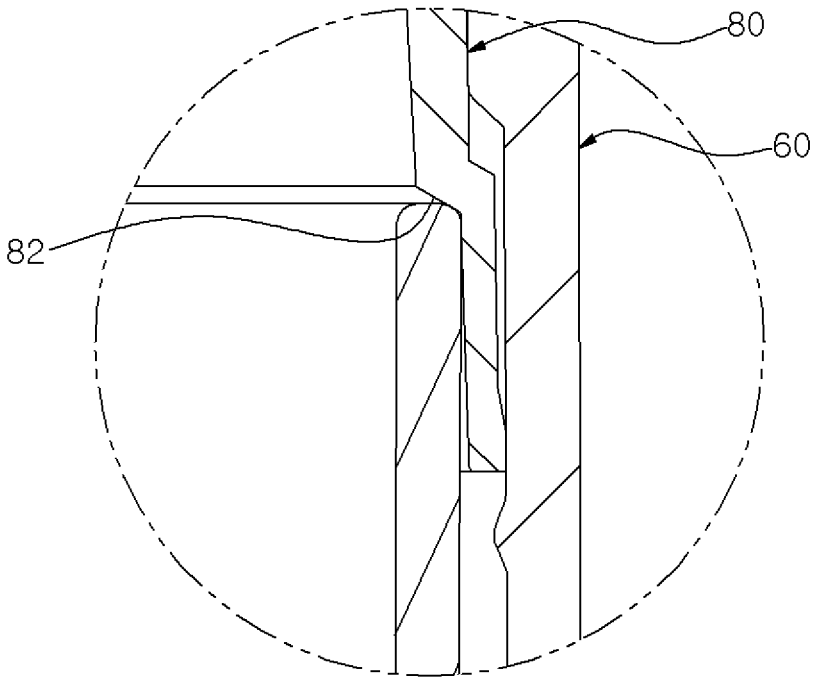
FIG. 6 is an enlarged view of portion C of FIG. 3.

FIG. 1 is a perspective view showing a stick container according to the embodiment of the present invention. FIG. 2 is an exploded perspective view of the stick container according to the embodiment of the present invention. FIG. 3 is a sectional view showing the stick container according to the embodiment of the present invention. FIG. 4 is an enlarged view of portion A of FIG. 3. FIG. 5 is an enlarged view of portion B of FIG. 3. FIG. 6 is an enlarged view of portion C of FIG. 3.

As shown in the drawings, the stick container having a sealing structure for preventing a residue according to the embodiment of the present invention may include a main body 10, a sealing tube 20, a guide tube 30, a first holder 40, a second holder 50, and a main body cover 60.

Each component of the stick container having a sealing structure for preventing a residue according to the embodiment of the present invention will be described as follows.

The main body 10 has a cylindrical shape with one side open, so that a stick cosmetic S is ejected to the outside or inserted to the inside of the guide tube 30. In the drawing of the stick container according to one embodiment of the present invention, the main body 10 is shown as having a rigid cylindrical shape elongated along the ejected or inserted direction of the stick cosmetic S. However, the present invention is not limited thereto, and may also be formed in various shapes and formed of various materials.

As shown in FIG. 2, a rotating operation tube 12 is spaced apart from an outer wall inside the main body 10 at a predetermined interval. The rotating operation tube 12 has a shape of a tube (that collectively refers to an object having a body with a round circumference and a hollow inside) extending in a longitudinal direction of the main body 10, in which at least a portion of the second holder 50 may be inserted therein, and an elevation protrusion 12*a* may protrude from an inner circumference thereon so as to be screw-fastened to an elevation thread 52 of the second holder 50. The elevation protrusion 12*a* may be formed in a protrusion shape extending by a predetermined section along the inner circumference of the rotating operation tube 12, or may be formed in a thread shape screw-fastened to the elevation thread 52.

In addition, a filling hole 14 for filling the stick cosmetic S therethrough may be formed on one side of the main body 10, that is, on the other side of the open portion, and a lower cap 70 may be further provided to be coupled to the filling hole 14. The filling hole 14 is provided to fill the main body 10 with the stick cosmetic S in a lower filling manner.

As shown in FIG. 3, the lower cap 70 may be formed thereon with an inner extension protrusion wheel 72 vertically extending from one surface of a bottom plate and an outer extension protrusion wheel 74 outwardly spaced apart from the inner extension protrusion wheel 72 at a predetermined interval. An inner sealing protrusion 72*a* and an outer sealing protrusion 74*a* may be formed on outer circumferences of the inner extension protrusion wheel 72 and the outer extension protrusion wheel 77, respectively, so as to dually seal the inside of the main body 10 while coming into tight contact with a lower inner wall of the main body 10.

The sealing tube 20 is inserted into the open portion of the main body 10 so as to be fixedly coupled to the inside of the main body 10. As shown in FIG. 2, the sealing tube 20 is formed in a cylindrical shape with open upper and lower portion, and disposed between the main body 10 and the guide tube 30 to simultaneously seal spaces between the main body 10 and the sealing tube 20 and between the sealing tube 20 and the guide tube 30.

A seating protrusion wheel 22 seated on an upper end of the main body 10 protrudes on an outer circumference of the sealing tube 20, in which a sealing part 24 inserted into the main body 10 to seal the space between the body 10 and the guide tube 30 may be formed at one side of the seating protrusion wheel 22, and a detachable part 26 exposed to the outside of the main body 10 and detachably coupled to the main body cover 60 may be formed at the other side of the seating protrusion wheel 22.

As shown in FIG. 4, a first sealing part 24*a* may be formed at an end of the sealing part 24 of the sealing tube 20. The first sealing part 24*a* may be formed to be opened outward toward the end of the sealing part 24 to come into close contact with the inner circumference of the main body 10, thereby stably maintaining airtightness inside the main body 10 while blocking the gap between the main body 10 and the sealing tube 20. The main body 10 may have an inner diameter at a portion in contact with the sealing part 24 so as to be smaller than other portions. This is configured such that the sealing part 24 is easily inserted into the main body 10 and the first sealing part 24*a* simultaneously comes into strongly close contact with a portion of the inner circumference of the main body 10.

As shown in FIG. 5, a second sealing part 24*b* may be formed on the inner circumference of the sealing part 24 of the sealing tube 20. The second sealing part 24*b* may protrude along the inner circumference of the sealing part 24 to come into close contact while surrounding the outer circumference of the guide tube 30, thereby stably maintaining the airtightness inside the guide tube 30 while blocking the gap between the guide tube 30 and the sealing tube 20. An elastic groove 24*c* may be formed on an opposite side of the second sealing part 24*b* so that the sealing part 24 may have a partially thinned thickness. This is configured such that the second sealing part 24*b* is outwardly opened more elastically upon coming into contact with the outer circumference of the guide tube 30.

In addition, as shown in FIG. 3, a first locking protrusion 24*d* may protrude from the inner circumference of the sealing part 24 of the sealing tube 20.

The guide tube 30 may be rotatably coupled to the inner space of the main body 10, so as to guide linear movements of the first holder 40 and the second holder 50 formed therein.

As shown in FIG. 2, an inlet part 32 through which the stick cosmetic S is drawn out or drawn in may be formed on one side of the guide tube 30, in which at least a portion thereof may be inserted into the sealing tube 20 and rotatably fastened to the sealing tube 20, and the remaining portion may be exposed to the outside of the main body 10.

A partition plate 34 may be formed inside the guide tube 30, in which the partition plate 34 may divide the inner space of the guide tube 30 into a space in which the cosmetic stick S is moved and a space in which the first and second holders 40 and 50 are lifted and lowered. the partition plate 34 may be formed therein with a first through-hole 34*a* through which the first holder 40 passes to guide the linear movement of the first holder 40, and a second-through hole 34*b*, through which the second holder 50 passes to guide the linear movement of the second holder 50, may be formed at an inner side of the first through-hole 34*a*. It may be preferable that the second through-hole 34*b* is formed in an oval shape or a circular shape in which at least a portion is a straight side such that the guide tube 30 and the second holder 50 are rotatable together.

In addition, a second locking protrusion 36 may protrude from the outer circumference of the guide tube 30 so as to be locked and coupled to the first locking protrusion 24*d* of the sealing tube 20, so that the guide tube 30 may be prevented from being separated from the main body 10.

The first holder 40 is movably coupled into the guide tube 30 in a straight line along the longitudinal direction of the guide tube 30.

The first holder 40 is mounted therein with the stick cosmetic S to draw out or draw in the stick cosmetic S while moving the stick cosmetic S along the guide tube 30, and may include an accommodation part 42 for accommodating the cosmetic stick S and a lower extension part 44 extending downward from the accommodation part 42.

The accommodation part 42 may be formed in a bottom portion thereof with a holder through-hole 42*a* through which the second holder 50 passes, and have an inner circumference and a bottom surface from which at least one contact plate 42*b* extends toward a center thereof, thereby increasing the adhesion between the accommodation part 42 and the stick cosmetic S. In other words, a plurality of contact plates 42*b* having relatively wide both sides penetrate into the stick cosmetic S to increase the contact area between the contact plate 42*b* and the cosmetic stick S, thereby preventing the cosmetic stick S from being easily separated from the accommodation part 42. The height of an outer wall of the accommodation part 42 or the number, size or shape of the contact plate 42*b* may be variously changed for the adhesion between the stick cosmetic S and the accommodation part 42 and the stable fixation of the stick cosmetic S.

As shown in FIG. 3, the lower extension part 44 is coupled to the inside of the guide tube 30 while passing through the first through-hole 34*a* of the guide tube 30, in which a first separation prevention protrusion 44*a* may protrude from the outer circumference of the lower extension part 44 to limit the linear movement section of the first holder 40. In other words, when the first holder 40 ascends for a predetermined section and the first separation prevention protrusion 44*a* is caught on the partition plate 34 of the guide tube 30, the ascending of the first holder 40 is stopped and only the second holder 50 coupled to the inside of the first holder 40 ascends, so that the second holder 50 pushes the stick cosmetic S remaining in the accommodation part 42 of the first holder 40 to the outside, and accordingly, the residue of the stick cosmetic S may be entirely used. It may be preferable that at least one pair of the lower extension part 44 of the first holder 40 is formed on one side of the accommodation part 42 for the stable linear movement of the first holder 40.

The second holder 50 is movably coupled to the inside of the first holder 40 in a straight line along the longitudinal direction of the first holder 40.

The second holder 50 is screw-coupled to the main body 10, moved in a straight line by the rotation of the main body 10 and lifted and lowered alone or together with the first holder 40, and may include a holder plate 52 disposed inside the first holder 40 to push out the stick cosmetic S accommodated in the first holder 40, and an elevation part 54 extending from one side of the holder plate 52.

As shown in FIG. 2, at least one slit 52*a* is formed in an edge portion of the holder plate 52, in which the contact plate 42*b* of the first holder 40 is inserted into the slit 52*a*, and accordingly, the second holder 50 is stably linearly moved without being idle from the first holder 40.

The elevation part 54 is coupled to the inside of the guide tube 30 while passing through the second through-hole 34*b* of the guide tube 30, in which an elevation thread 54*a* is formed on an outer circumference of the elevation part 54 so as to be screw-coupled to the elevation protrusion 12*a* of the main body 10, and lifted and lowered by rotating the main body 10. In addition, a second separation prevention protrusion 54*b* may protrude from the lower outer circumference of the elevation part 54 to limit the linear movement section of the second holder 50. In other words, when the second holder 50 solely ascends inside the first holder 40 and the second separation prevention protrusion 54*a* is caught on the partition plate 34 of the guide tube 30, the ascending of the second holder 50 is stopped.

In addition, as shown in FIG. 3, a first locking protrusion wheel 42*c* may protrude from the inner circumference of the accommodation part 42 of the first holder 40, and a second locking protrusion wheel 54*c* may protrude from the outer circumference of the elevation part 54 of the second holder 50, so as to be locked and coupled to each other, so that the first holder 40 and the second holder 50 may be lifted and lowered together in a predetermined section. In other words, the first holder 40 is moved upward together with the second holder 50 by rotation of the main body 10 in a state in which the first locking protrusion wheel 42*c* of the first holder 40 and the second locking protrusion wheel 54*c* of the second holder 50 are locked and coupled to each other. Immediately when the first separation prevention protrusion 44*a* of the first holder 40 is caught on the partition plate 34 of the guide tube 30, the second locking protrusion wheel 54*c* of the second holder 50 passes over the first locking protrusion wheel 42*c* of the first holder 40, and thus only the second holder 50 is moved upward.

The main body cover 60 opens or closes at least a portion of the guide tube 30 while being fastened to the detachable part 26 of the sealing tube 20. In the drawings of the stick container according to the embodiment of the present invention, the main body 10 and the main body cover 60 are shown as being fastened by the protrusion and the groove. However, the present invention is not limited thereto, and may have various types of fastening structures, such as undercut coupling, forced fitting coupling, and magnetic coupling, within a range for allowing the body cover 60 to be easily detachably fastened to the main body 10.

In addition, a sealing cap 80 may be provided inside the main body cover 60 to seal the inlet part 32 of the guide tube 30. As shown in FIG. 6, the sealing cap 80 stably seals the inlet part 32 of the guide tube 30 while outwardly enclosing the end of the guide tube 30. An oblique surface 82 may be formed on an inner circumference of the sealing cap 80 to come into close contact with an upper edge of the guide tube, and the lower inner circumference of the sealing cap 80 may simultaneously come into close contact with the upper outer circumference of the guide tube 30.

As described above, the present invention relates to a stick container in which the first holder 40 and the second holder 50 are sequentially lifted and lowered by the rotation operation of the main body 10, so as to entirely use the stick cosmetic S attached to the first and second holders 40 and 50 without wasting, in which the sealing tube 20 is provided between the main body 10 and the guide tube 30 to simultaneously seal the gaps between the main body 10 and the sealing tube 20 and between the sealing tube 20 and the guide tube 30, and the sealing cap 80 is provided on the inside of the body cover 60 to seal the inlet part 32 of the guide tube 30, so that the stick cosmetic S accommodated in the guide tube 32 can be prevented from being contaminated and deteriorated when being carried or stored. In other words, the stick cosmetic S is accommodated inside the guide tube 30, and portions of the guide tube 30 with the possibility of inflow of external air are effectively sealed through the sealing tube 20 and the sealing cap 80, so that the airtightness inside the guide tube 30 can be more stably maintained.

Figure 7:
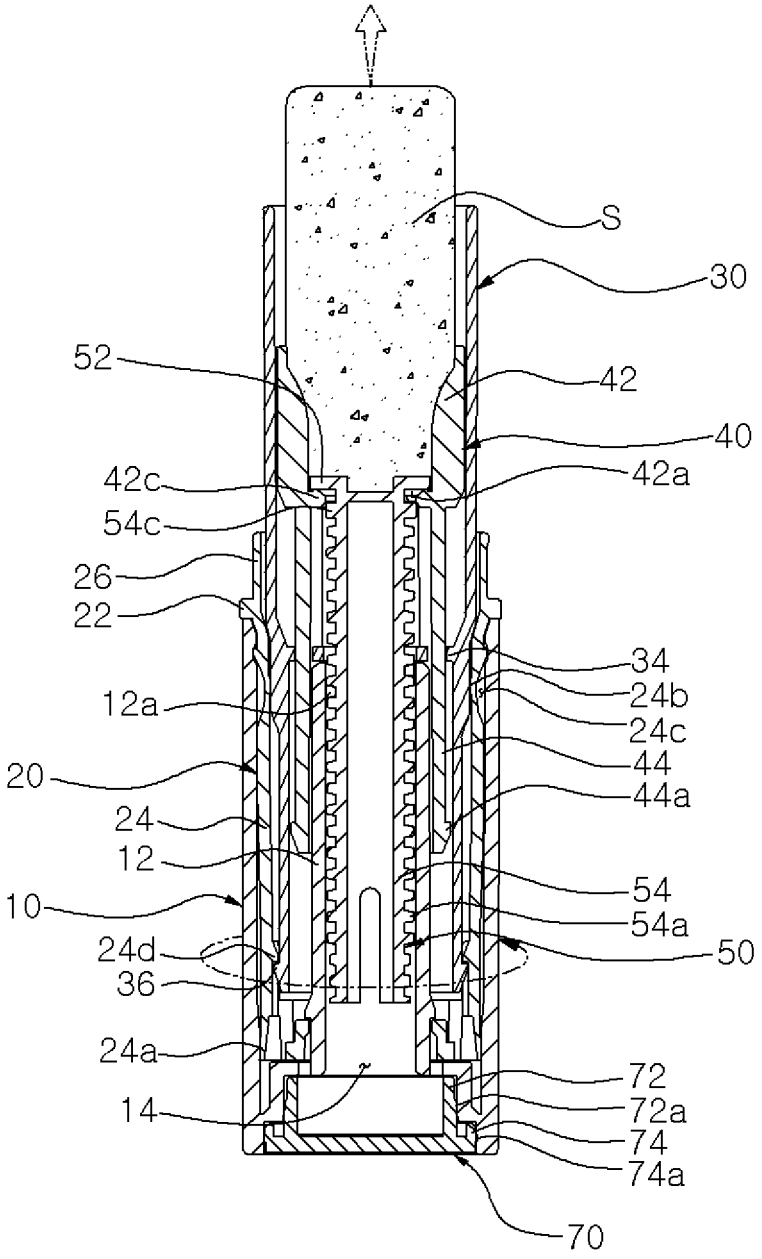
FIG. 7 is a sectional view illustrating a state in which a first holder and a second holder are lifted together according to the embodiment of the present invention.
Figure 8:
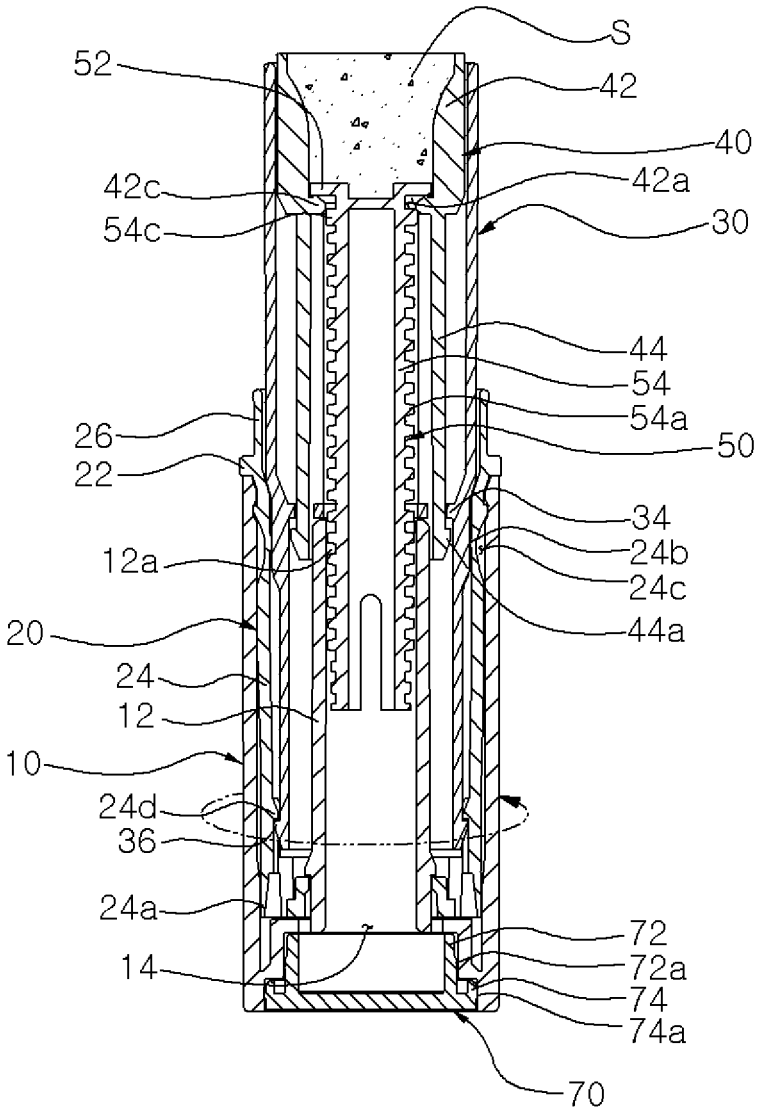
FIG. 8 is a sectional view illustrating a state in which the lifting of the first holder is restricted according to the embodiment of the present invention.
Figure 9:
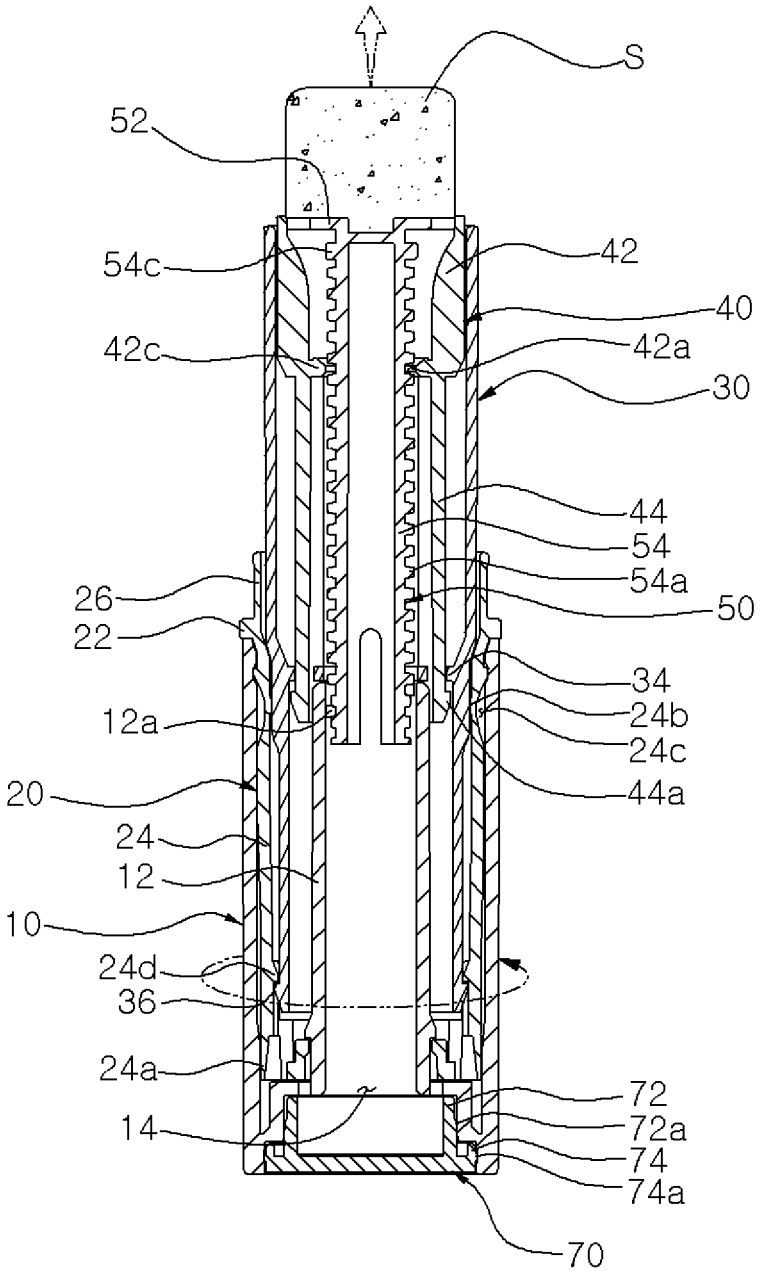
FIG. 9 is a sectional view illustrating a state in which the second holder is lifted according to the embodiment of the present invention.

FIGS. 7 to 9 are views illustrating the operation processes of the stick container having a sealing structure for preventing a residue according to the embodiment of the present invention. The use process of the stick container having a sealing structure for preventing a residue according to the embodiment of the present invention will be described with reference to the above drawings.

FIG. 7 is a sectional view illustrating a state in which the first holder and the second holder are lifted together according to the embodiments of the present invention. FIG. 8 is a sectional view illustrating a state in which the lifting of the first holder is restricted according to the embodiments of the present invention. FIG. 9 is a sectional view illustrating a state in which the second holder is lifted according to the embodiments of the present invention.

In order to use the stick container having a sealing structure for preventing a residue according to the embodiments of the present invention, first, the main body cover 60 is separated from the main body 10 to expose the guide tube 30 to the outside.

Then, as shown in FIG. 7, when the guide tube 30 is held by one hand and the main body 10 is rotated by the other hand, the sealing tube 20 fitted inside the main body 10 is rotated together with the main body 10. The main body 10 and the sealing tube 20 are rotated, however, the guide tube 30 held by the user and the first and second holders 40 and 50 coupled to the inside of the guide tube 30 are restricted in rotation, and accordingly, the second holder 50 screw-coupled to the main body 10 and the first holder 40 locked and coupled to the second holder 50 are moved upward together along the guide tube 30, so that the cosmetic stick S attached to the first holder 40 is drawn outward through the inlet part 32 of the guide tube 30.

Thereafter, the cosmetic stick S drawn to the outside from the guide tube 30 is evenly applied to the skin during makeup.

In addition, as shown in FIG. 8, in order to use the residue of the stick cosmetic S remaining inside the first holder 40 when the stick cosmetic S attached to the first holder 40 is almost used, the main body 10 is rotated so that the second holder 50 screw-coupled to the main body 10 and the first holder 40 locked and coupled to the second holder 50 are moved upward together along the guide tube 30, and then the first separation prevention protrusion 44*a* of the first holder 40 is caught on the partition plate 34 of the guide tube 30, thereby stopping the ascending of the first holder 40.

Thereafter, as shown in FIG. 9, when the main body 10 is continuously rotated, the second locking protrusion wheel 54*c* of the second holder 50 passes over the first locking protrusion wheel 42*c* of the first holder 40, and only the second holder 50 is moved upward, so that the holder plate 52 of the second holder 50 pushes the cosmetic stick S remaining inside the accommodation part 42 of the first holder 40 to the outside.

After the makeup is completed, the main body 10 is rotated in the opposite direction to insert the cosmetic stick S into the guide tube 30, and then the main body cover 60 covers the guide tube 30 and is coupled to the sealing tube 20 again so as to be stored or carried. The first sealing part 24*a* of the sealing tube 20 comes into close contact with the inner circumference of the main body 10 to seal the space between the main body 10 and the sealing tube 20, and the second sealing part 24*b* simultaneously comes into close contact with the outer circumference of the guide tube 30 to seal the space between the sealing tube 20 and the guide tube 30, and the sealing cap 80 of the main body cover 60 covers and comes into close contact with the inlet part 32 of the guide tube 30, thereby sealing the inside of the guide tube.

Although the invention has been described with the particulars such as specific elements, the limited embodiments, and the drawings, the above description is provided only to help comprehensive understanding of the present invention, and the present invention is not limited to the above embodiments. It is obvious to those skilled in the art that various changes and modifications may are available. Therefore, the spirit of the present invention should not be limited to the aforementioned embodiments, and the following claims as well as all modifications or variations belonging to the equivalents of the claims will be within the scope of the invention.

What is claimed is:

1. A stick container having a sealing structure for preventing a residue, the residual quantity prevention stick container comprising:

a main body formed thereon with an elevation protrusion;

a sealing tube coupled to an inside of the main body, and formed therein with a first sealing part and a second sealing part;

a guide tube rotatably coupled to the inside of the body, and formed on one side thereof with an inlet part;

a first holder coupled to an inside of the guide tube so as to be movable in a straight line, in which a stick cosmetic is attached to the first holder;

a second holder coupled to an inside of the first holder, and formed thereon with an elevation thread; and a main body cover opening and closing at least a portion of the guide tube, and formed therein with a sealing cap, wherein the first sealing part comes into close contact with an inner circumference of the main body to seal a space between the main body and the sealing tube, and the second sealing part simultaneously comes into close contact with an outer circumference of the guide tube to seal a space between the sealing tube and the guide tube, and the sealing cap covers and comes into close contact with the inlet part of the guide tube, thereby sealing an inside of the guide tube, and wherein the guide tube is formed therein with a partition plate, in which the partition plate is formed therein with a first through-hole through which the first holder passes to guide a linear movement of the first holder, and a second-through hole, through which the second holder passes to guide a linear movement of the second holder, is formed at an inner side of the first through-hole.

2. The residual quantity prevention stick container of claim 1, wherein the main body is formed on one side thereof with a filling hole through which the stick cosmetic is filled, and a lower cap is coupled to the filling hole.

3. The residual quantity prevention stick container of claim 2, wherein the lower cap is formed thereon with an inner extension protrusion wheel and an outer extension protrusion wheel outwardly spaced apart from the inner extension protrusion wheel at a predetermined interval, in which the inner extension protrusion wheel and the outer extension protrusion wheel are formed thereon with an inner sealing protrusion and an outer sealing protrusion, respectively, thereby dually sealing the inside of the main body while coming into close contact with an inner wall of the main body.

4. The residual quantity prevention stick container of claim 1, wherein a seating protrusion wheel seated on an upper end of the main body protrudes on an outer circumference of the sealing tube, in which the seating protrusion wheel is formed at one side thereof with a sealing part inserted into the main body to seal a space between the main body and the guide tube, and the seating protrusion wheel is formed at an opposite side thereof with a detachable part exposed to an outside of the main body and detachably coupled to the main body cover.

5. The residual quantity prevention stick container of claim 4, wherein the first sealing part is formed to be opened outward toward an end of the sealing part to come into close contact with the inner circumference of the main body.

6. The residual quantity prevention stick container of claim 4, wherein the second sealing part protrudes along an inner circumference of the sealing part to come into close contact while surrounding the outer circumference of the guide tube.

7. The residual quantity prevention stick container of claim 1, wherein a first locking protrusion protrudes from the inner circumference of the sealing tube, and a second locking protrusion protrudes from the outer circumference of the guide tube so as to be locked and coupled to each other.

8. The residual quantity prevention stick container of claim 1, wherein the first holder includes an accommodation part for accommodating the cosmetic stick, and a lower extension part extending from the accommodation part to one side.

9. The residual quantity prevention stick container of claim 1, wherein the second holder includes a holder plate disposed inside the first holder to push out the stick cosmetic accommodated in the first holder, and an elevation part extending from one side of the holder plate and lifted and lowered by rotating the main body.

10. The residual quantity prevention stick container of claim 1, wherein the first holder and the second holder are formed thereon with a first locking protrusion wheel and a second locking protrusion wheel, respectively, so as to be locked and coupled to each other so that the first holder and the second holder are lifted and lowered together in a predetermined section.

11. The residual quantity prevention stick container of claim 1, wherein the sealing cap is formed on an inner circumference thereof with an oblique surface to come into close contact with an upper edge of the guide tube, and the inner circumference of the sealing cap simultaneously comes into close contact with an upper outer circumference of the guide tube.

* * * * *